US006860472B2

(12) United States Patent
Striebel et al.

(10) Patent No.: US 6,860,472 B2
(45) Date of Patent: Mar. 1, 2005

(54) QUICK RAIL SYSTEM

(75) Inventors: Roman F. Striebel, Duxbury, MA (US); Patrick A. Striebel, Pembroke, MA (US)

(73) Assignee: Suncor Stainless, Inc., Pembroke, MA (US)

( * ) Notice: Subject to any disclaimer, the term of this patent is extended or adjusted under 35 U.S.C. 154(b) by 108 days.

(21) Appl. No.: 10/154,213

(22) Filed: May 23, 2002

(65) Prior Publication Data

US 2003/0006405 A1 Jan. 9, 2003

Related U.S. Application Data

(60) Provisional application No. 60/293,040, filed on May 23, 2001.

(51) Int. Cl.[7] ..... E04H 17/14

(52) U.S. Cl. ..... 256/65.03; 256/65.05

(58) Field of Search ..... 256/65.01–65.06, 256/65.11, 59, 65.15, 65.16, 1

(56) References Cited

U.S. PATENT DOCUMENTS

| | | | | |
|---|---|---|---|---|
| 4,703,769 | A | | 11/1987 | Harrison, Jr. |
| 4,856,761 | A | | 8/1989 | Berner |
| 5,288,048 | A | | 2/1994 | Shreiner |
| 5,427,359 | A | | 6/1995 | Moulton |
| 5,437,433 | A | | 8/1995 | Rezek |
| 5,765,812 | A | | 6/1998 | Guenther |
| 5,788,224 | A | * | 8/1998 | Platt ..... 256/66 |
| 6,203,233 | B1 | * | 3/2001 | Stanley ..... 256/65.03 X |
| 2002/0134976 | A1 | | 9/2002 | Swartz |

* cited by examiner

*Primary Examiner*—John R. Cottingham
(74) *Attorney, Agent, or Firm*—Perkins Smith & Cohen LLP; Jacob N. Erlich; Jerry Cohen

(57) ABSTRACT

A modular railing system is disclosed which is based on commercially available tubing, which is connected into a railing by especially designed fittings, which connect to each other and the rails and posts of the railing system to allow all possible standard rail configuration. All connections are thereby held together by mechanical connections, instead of welded connections.

27 Claims, 10 Drawing Sheets

QUICK RAIL SYSTEM

CROSS REFERENCE TO RELATED APPLICATIONS

This application claims priority of U.S. provisional application Ser. No. 60/293,040 entitled "Quick Rail System", filed May 23, 2001, such application being incorporated herein by reference.

FIELD OF THE INVENTION

This invention relates generally to railings, and, more particularly to modular systems suitable for commercial and private railings and balustrades.

BACKGROUND OF THE INVENTION

Metal railing systems, but more especially stainless steel railing systems, presently on the market usually require components to be welded together to form the required shapes and frames. This can only be achieved in a workshop environment, and is very time consuming due to the required polishing of the welded seams. On modular metal systems, which do exist, the connections are either complicated, unsuitable for consumer installation or unsightly, making most of these systems only suitable for factory or some commercial installations.

In addition, the requirements of many building authorities for vertical spacing of spindles or similar components in balusters to prevent small children from falling through the gaps, makes the use of existing stainless components prohibitively expensive, as those systems are labor intensive and/or require many fittings.

It is therefore an object of this invention to improve the ease of installation and construction of railings for decks, balconies, marine docks, tennis courts, and other applications, which require a barrier for safety, esthetics or a separation.

It is a further object of this invention to offer the lowest possible number of components with which to cover virtually all variations encountered in the above applications, and to provide components in such a way, that the installation can be done by moderately skilled consumers with very simple tools, or by professional contractors in far shorter installation times than is possible presently. A special feature of the system is the possibility to use either vertical spindles or balusters, or to use virtually any horizontal cable or wire system on the market today, as determined by the architect, and/or in accordance with any relevant building regulations.

It is a further object of this invention to offer maximum corrosion resistance and an essentially maintenance free railing system, yet be price competitive with other materials, which do not offer these advantages, through the use of innovative design and manufacturing of the individual components.

SUMMARY OF THE INVENTION

The objects set forth above as well as further and other objects and advantages of the present invention are achieved by the embodiments of the invention described herein below.

The invention is based on commercially available stainless steel (or other material) tubing, which is connected into a railing, or into a framework by especially designed fittings, which allow all possible standard rail configuration. The common item to all such fittings is a special dovetail connector, which accepts all fittings, and which is easy to attach to the tubing, yet provides a safe and largely tamper-proof connection.

The outer framework of the tubing is very similar for virtually all applications, whether the inside consists of commercially available horizontal wire or cable systems, or uses the spindles in a baluster system, which is part of this invention, except that the lower tubing may be omitted for the horizontal cables.

Whereas most installations require vertical tubing or "uprights" to be mounted on a horizontal surface, it is sometimes desirable to attach uprights to a vertical surface, and therefore the system has been designed for both possibilities.

It is also a common requirement for steps to lead from or to the railing, and for these steps to either be in line or at right angles (either left or right) to the railing. All four possibilities are covered in this invention, as are all possible angles of such steps either up or down, using the identical fitting.

Also common to the system is, that all connections may be held together by mechanical connections, instead of welded connections. The connections may further be held together by a commercially available epoxy, yet the system only relies on the epoxy to prevent rattles or vibration, and will stay together safely through the mechanical connections even if the epoxy fails, has been badly applied, or is not there.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

The railing system of the present invention comprises a plurality of vertical tubes or posts, one or more horizontal rails extending between adjacent posts, and a modular connecting means for connecting the vertical posts to the horizontal rails. Posts are installed on either a vertical or horizontal surface through a mounting base, either alone or in combination with a base bracket.

Figure 1A:
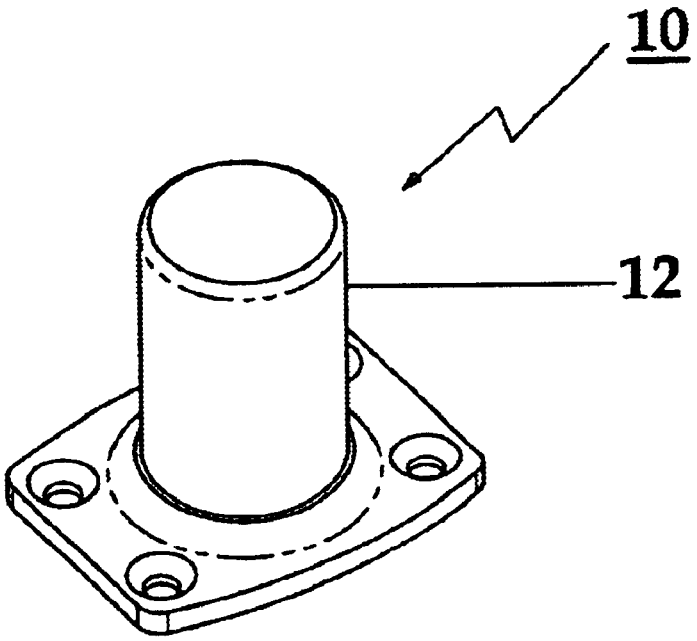
FIG. 1*a* is a pictorial view of a mounting base of this invention.
Figure 1B:
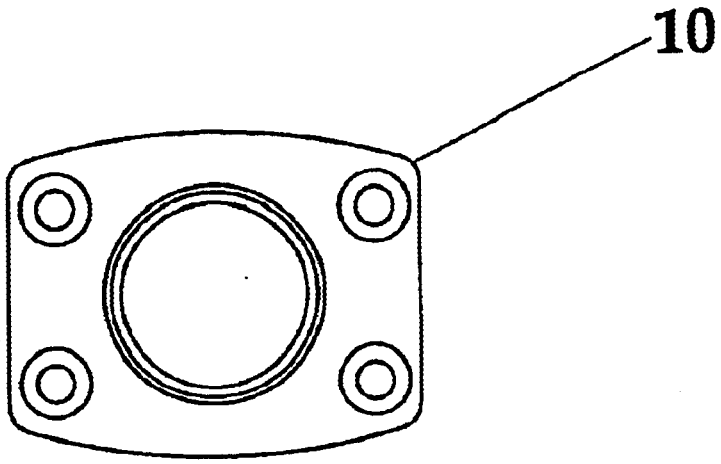
FIG. 1*b* is a bottom view of the mounting base of this invention.

FIGS. 1*a* and 1*b* show an illustration of the mounting base 10 used for all posts or uprights. The base 10 features a spigot 12, which fits snugly inside a standard tube (not shown). The base may also have recessed holes 16 for attachment to a surface or other railing system component by bolts or screws. The base 10 is preferably symmetrical, and can therefore be turned 180 degrees, which is of benefit since it reduces the amount of prefabricated base assemblies which need to be offered for use with the present invention. An upright standard tube or post can be fitted on site to the spigot 12 of the base 10 using an epoxy, or could be supplied with the base 10 as a welded and polished assembly having the correct height, thus saving on installation time. It is also possible to use the base 10 for a horizontally oriented tubular component, such as when connecting a horizontal rail component to a pre-existing wall.

Figure 2A:
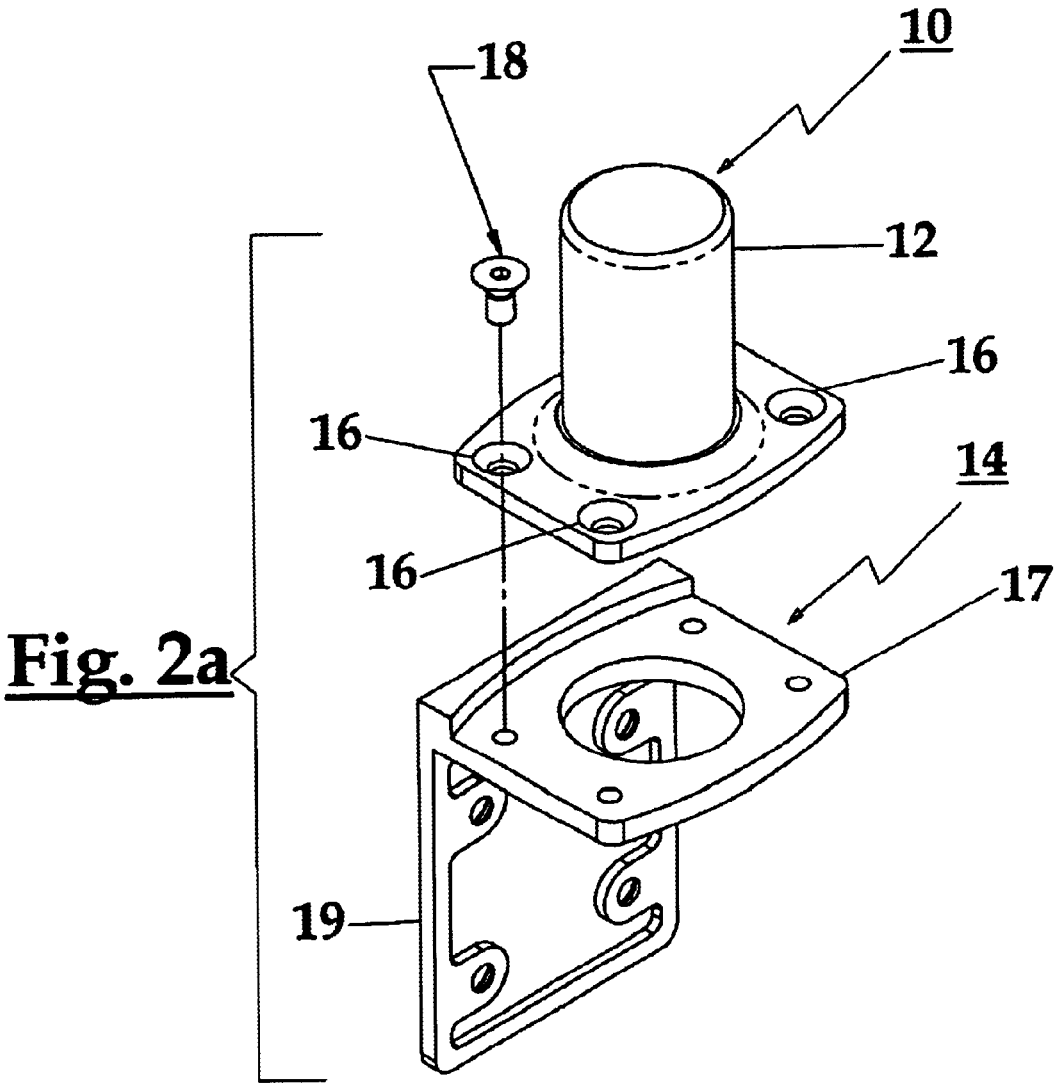
FIG. 2*a* is an exploded pictorial view of a base bracket for mounting on a vertical surface.
Figure 2B:
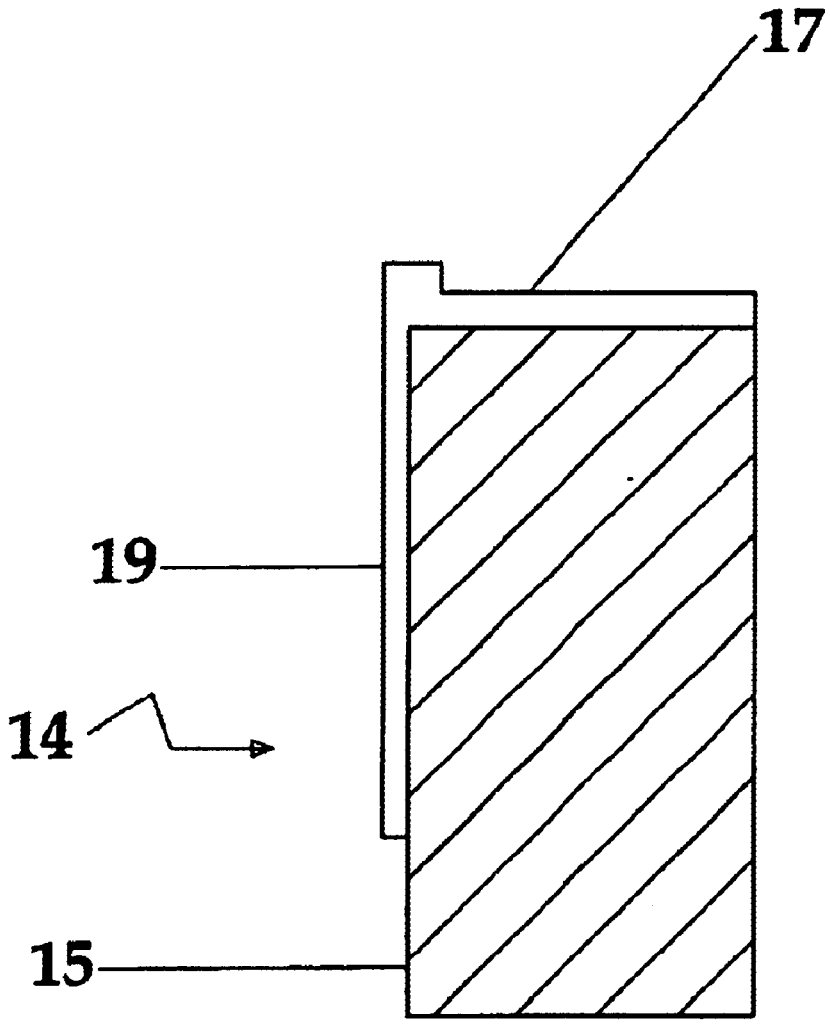
FIG. 2*b* is a pictorial side view of the base bracket mounted on a vertical surface.

FIG. 2*a* is an illustration of a base bracket 14 for use in vertical mounting in the mounting base 10 of the present invention. The base bracket 14 is used when the railing needs to be mounted on a vertical surface 15, such as shown in FIG. 2*b*, inwards and over the top of the surface 15. The top flange 17 of the base bracket 14 is shaped in such a way as to accept the mounting base 10 and to provide a strong support against side loading from any direction. In FIG. 2*a*, the top flange 17 is shown with an aperture of the same size as the spigot 12 of the base 10. However, in an alternate embodiment (not shown), the top flange 17 may also be a solid layer of material. If recessed holes 16 are used in the base 17, the top flange 17 may also have recessed holes 16 to receive screws or bolts for attachment. The recessed holes 16 in the base 10 can be provided with screws 18 of a suitable size to allow the mounting base 10 to be connected to the top flange 17 of the base bracket 14. Attached to the top flange 17 at a right angle is a side flange 19 capable of being attached to a vertical surface 15, as shown in FIG. 2*b*, through bolts, screws or other means, such as adhesives, known in the art depending upon the material of that surface.

In another embodiment of the base bracket 14, the base bracket 14 is manufactured reversed. That is, the base 14 will be a mirror image of the embodiment shown in FIG. 2*a*, which will allow the post to be mounted away from the vertical surface 15 as opposed to inwards over the vertical surface 15. The same features and requirements of the base bracket 14 discussed above will apply.

Figure 3A:
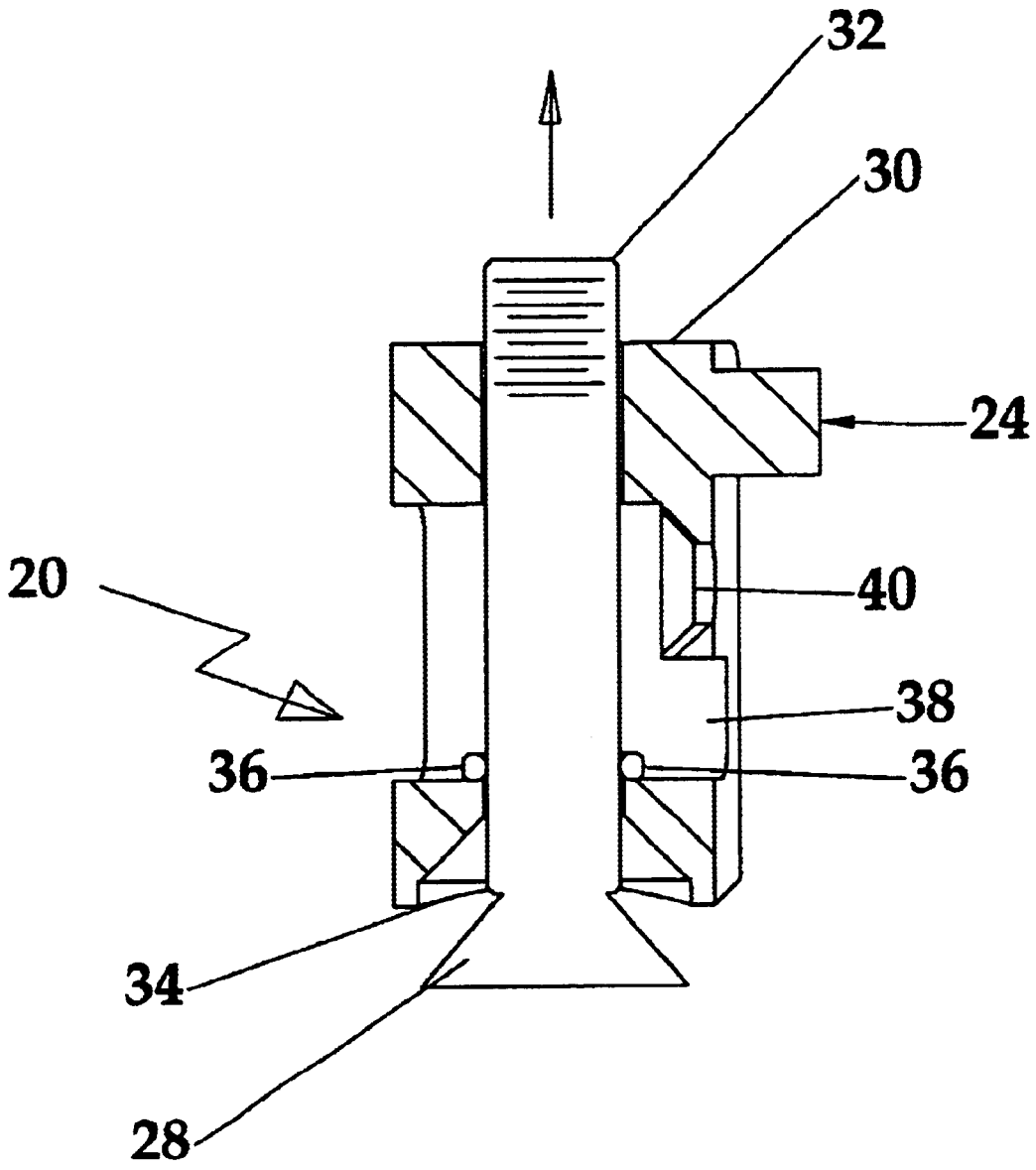
FIG. 3*a* is a partial cross-sectional view of a dovetail connector of this invention with a connecting screw.
Figure 3B:
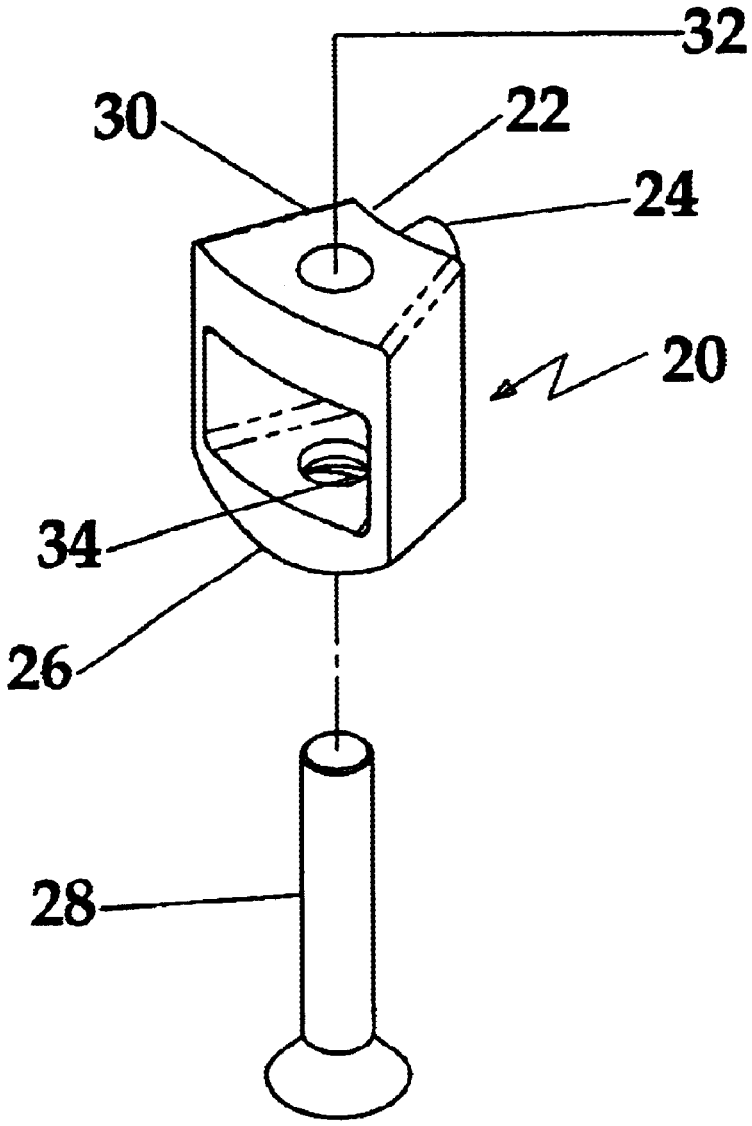
FIG. 3*b* is an exploded view of the dovetail connector of this invention shown with a connecting screw extending therefrom.

FIGS. 3*a* and 3*b* illustrate of a dovetail connector fitting 20 for use with the present invention. This fitting is the common mechanism used to fix all other connective fitting components to the posts, with the exception of the base 10 and bracket 14, and serves to connect any vertical tube to any horizontal tube. The dovetail connector 20 has several unique features.

The backside 22 of the dovetail connector 20 is shaped to a radius, which allows a perfect fit to the outside of a standard tube and is attached to the post. In a preferred embodiment, the dovetail connector back 22 has a short stub or spigot 24 and the standard tube or post has an aperture capable of receiving the stub or spigot which is used for initial location on the tube, and which greatly increases the shear strength vertically and horizontally when the system is in use. A commercially available glue or epoxy may also be used to secure the backside 22 of the dovetail connector to the post.

The dovetail connector underside 26 is shaped to perfectly complete the circular cross-section of any of the fitting components used in conjunction with the dovetail connector 20. This is aesthetically pleasing and offers no sharp corners or edges, as the connecting screw 28 is also recessed into that curved surface. The dovetail connector top 30 has a hole 32, which lines up with the recessed hole 34 in the underside 26. A suitable screw 28, which is commercially available but might have to be modified in length, is inserted into an aperture 34 on the underside 26 of the dovetail connector, passes through an aperture 32 in the top edge 30, which provides a perfect alignment, and finally enters a threaded hole inside each of the fitting components used in conjunction with the dovetail connector 20. When the screw 28 is tightened, the dovetail connector 20 and the matching fitting component are tightly connected and complement each other similar to a simple puzzle.

To facilitate alignment of the connecting screw 28 during assembly, and to prevent such screw from getting lost, it is preferable to fit a commercially available rubber "O" ring 36 of suitable size over the screw 28 in such a way, that the end of the screw is flush with the top edge 30 of the dovetail connector 20. This screw 28 is therefore "pre-loaded" for final assembly.

In one preferred embodiment, the dovetail connector 20 has a center opening 38 to allow small electric wires and the like to pass from the horizontal tubes into the vertical tubes, thus allowing LED lights to be installed. In yet another embodiment, the dovetail connector 20 has a recessed hole 40 which can be used to permanently fasten the dovetail connector 20 to the upright tube, either by welding, or by sheet-metal screw, or by a suitable rivet.

Figure 4A:
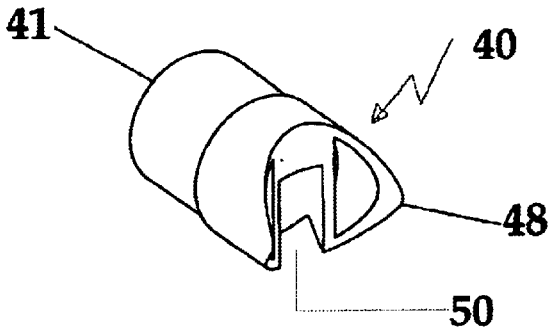
FIG. 4*a* is a pictorial view of a straight version of a rail connector of this invention.
Figure 4B:
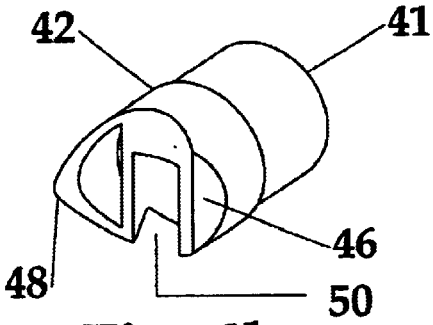
FIG. 4*b* is a pictorial view of a left version of a rail connector of this invention.
Figure 4C:
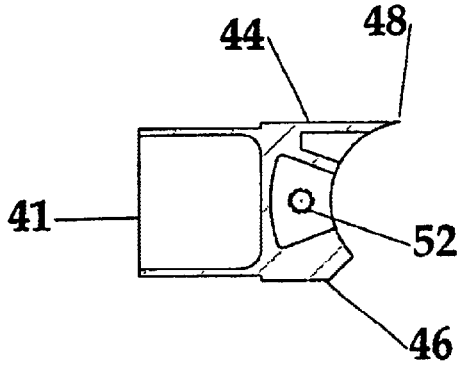
FIG. 4*c* is a cross-sectional view of a right version of a rail connector of this invention.
Figure 4D:
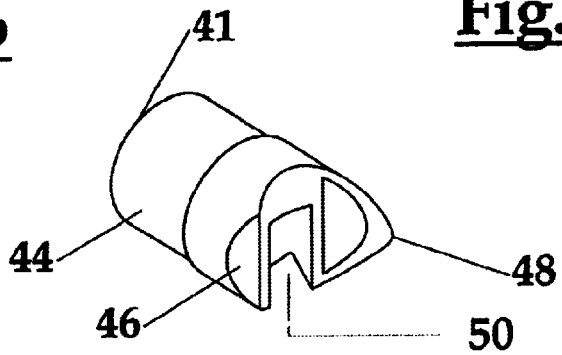
FIG. 4*d* is a pictorial view of a right version of a rail connector of this invention.

FIGS. 4*a–d* show illustrations of a rail connector fitting used in conjunction with the dovetail connector 20 described above. A straight rail connector 40, shown in FIG. 4*a*, allows rails to be in line, i.e. 180 degrees with respect to each other, with a possibility of 5 degrees variation either way, if required. The left rail connector 42, shown in FIG. 4*b*, and right rail connector 44, shown in FIG. 4*d*, are identical to the straight rail connector, except the left connector 42 and right connector 44 each have a shortened wing 46 with respect to wing 48, which allows them to be placed next to each on the post such that the sides having the shortened wing 46 are adjacent thus forming any 90 degree to 170 degree angle with respect to each other. Angles from 60 degrees to 90 degrees can be achieved by using the same left and right but the shortened wing 46 will have to be trimmed back by grinding it to suit the desired angle.

Referring also to FIG. 4*c*, there are several features common to all three fittings. The wings 46 and 48 are designed in such a way as to fit perfectly around the outside of a given tube, and to blend the horizontal tube into the vertical tube. Apart from being aesthetically very pleasing, as there are no sharp edges or corners, the wings 46 and 48 serve to further take significant side loads against the railing, such as those being experienced when a heavy person falls against it. In combination with the short stub 24 on the dovetail connector 20, which takes the smaller vertical load, and also contributes to horizontal loads, the rail system can take very significant side (horizontal) loads, which are essentially being limited only by the choice of tubing used.

The rail connector underside 50 is open and designed in such a way as to accept the dovetail connector 20 inside where it becomes hidden like a simple puzzle, except for the small exposed underside of it, which complements and closes the opening perfectly. An opening 41 on the end of the rail connector opposite the wings 46 and 48 is shaped to receive the end of a rail component.

Preferably, the rail connector internally threaded hole 52 near the top is designed to accept the end of the connecting screw 28 "pre-loaded" into the dovetail connector 20.

Figure 5A:
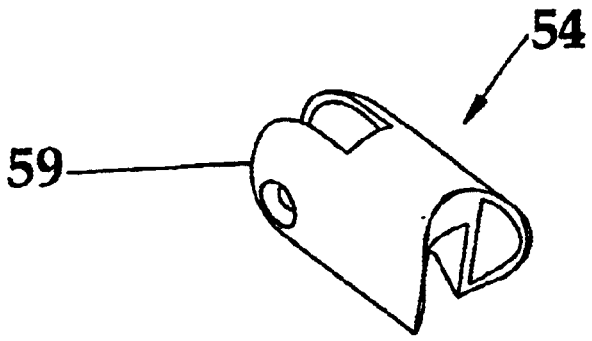
FIG. 5*a* is a pictorial view of a straight version of an adjustable rail connector of this invention.
Figure 5B:
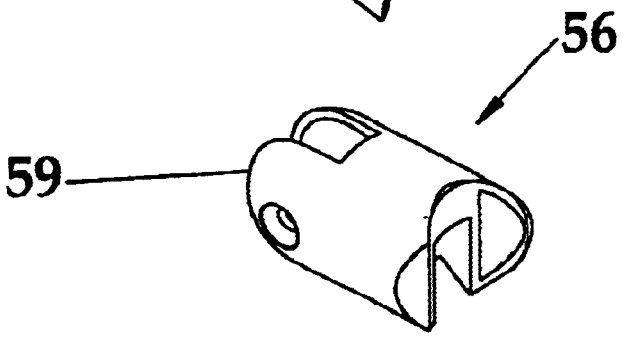
FIG. 5*b* is a pictorial view of a left version of an adjustable rail connector of this invention.
Figure 5C:
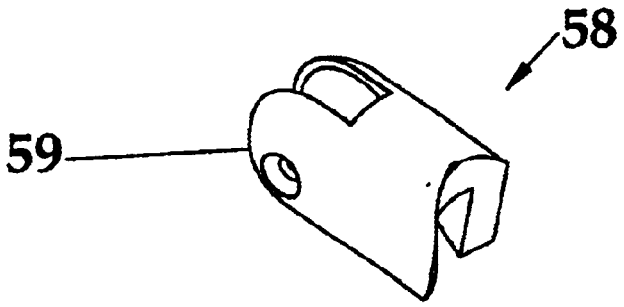
FIG. 5*c* is a pictorial view of a right version of an adjustable rail connector of this invention.

FIGS. 5*a*–5*c* show illustrations of the stair rail connectors which have been designed in three versions, a straight stair rail connector 56, a left adjustable rail connector 54 and right adjustable rail connector 58. The adjustable rail connectors are used to connect railings for up or down stairs to a standard railing. Each stair rail connector 54, 56 and 58 is identical to the rail connectors 40, 42 and 44 described above and shown in FIGS. 4*a*–4*d*, except that end 41 of is replaced by a conventional knuckle joint 59 in the stair rail connectors 54, 56 and 58. Thus, the left adjustable rail connector 56 and right adjustable rail connector 58 each have a shortened wing, which allows them to be placed next to each other on a post such that the shortened wings are adjacent, just as a left rail connector 42 and right rail connector 44 may be placed next to each other. Further, a left rail connector 42 or right rail connector 44 may be placed next to a right stair rail connector 58 or left stair rail connector 54, respectively, by locating the sides of the connectors having a shortened wing adjacent to each other. In addition to all the features embodied in the standard rail connectors the three fittings have additional common features.

Figure 5D:
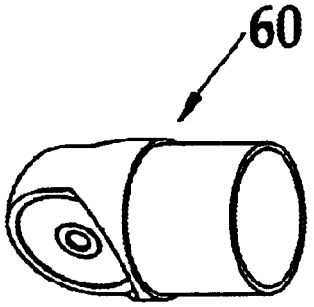
FIG. 5*d* is a pictorial view of a male rail adaptor of this invention.

FIG. 5*d* shows an adjustable male rail adaptor 60 that fits into the knuckle joint 59 of the stair rail connectors 54, 56 and 58. A suitable connecting screw is used which is commercially available. This arrangement allows the stair rail to be positioned at an angle within a vertical plane with respect to a post, and thus the same fitting can be used for a handrail for a stairway to either go up or done.

All possible standard uses of a connected stair handrail are covered such as a straight in-line connection, a left and right connection, and all of those either going up or down. A commercially available recessed screw fixes the up or down angle once selected.

Figure 6A:
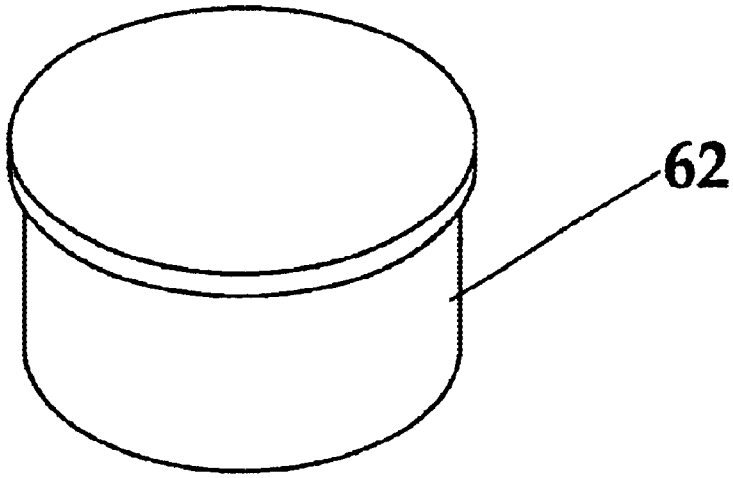
FIG. 6*a* is a pictorial view of one embodiment of a post cap used with a railing system of this invention.
Figure 6B:
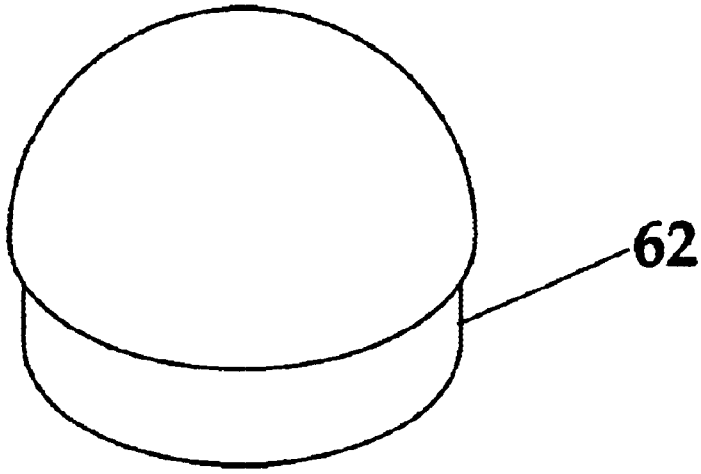
FIG. 6*b* is a pictorial view of a second embodiments of a post cap used with a railing system of this invention.

FIGS. 6*a* and 6*b* show two embodiments of post caps 62 for use with the present invention to close the top of the vertical tube. Those skilled in the art will recognize that several varieties of caps may be used in the railing system, thus allowing for different appearances at a low cost. For example, the embodiment shown in FIG. 6*a*, the post cap 62 has a flat top surface, while in the embodiment shown in FIG. 6*b*, the post cap 62 has a domed crown.

Figure 7:
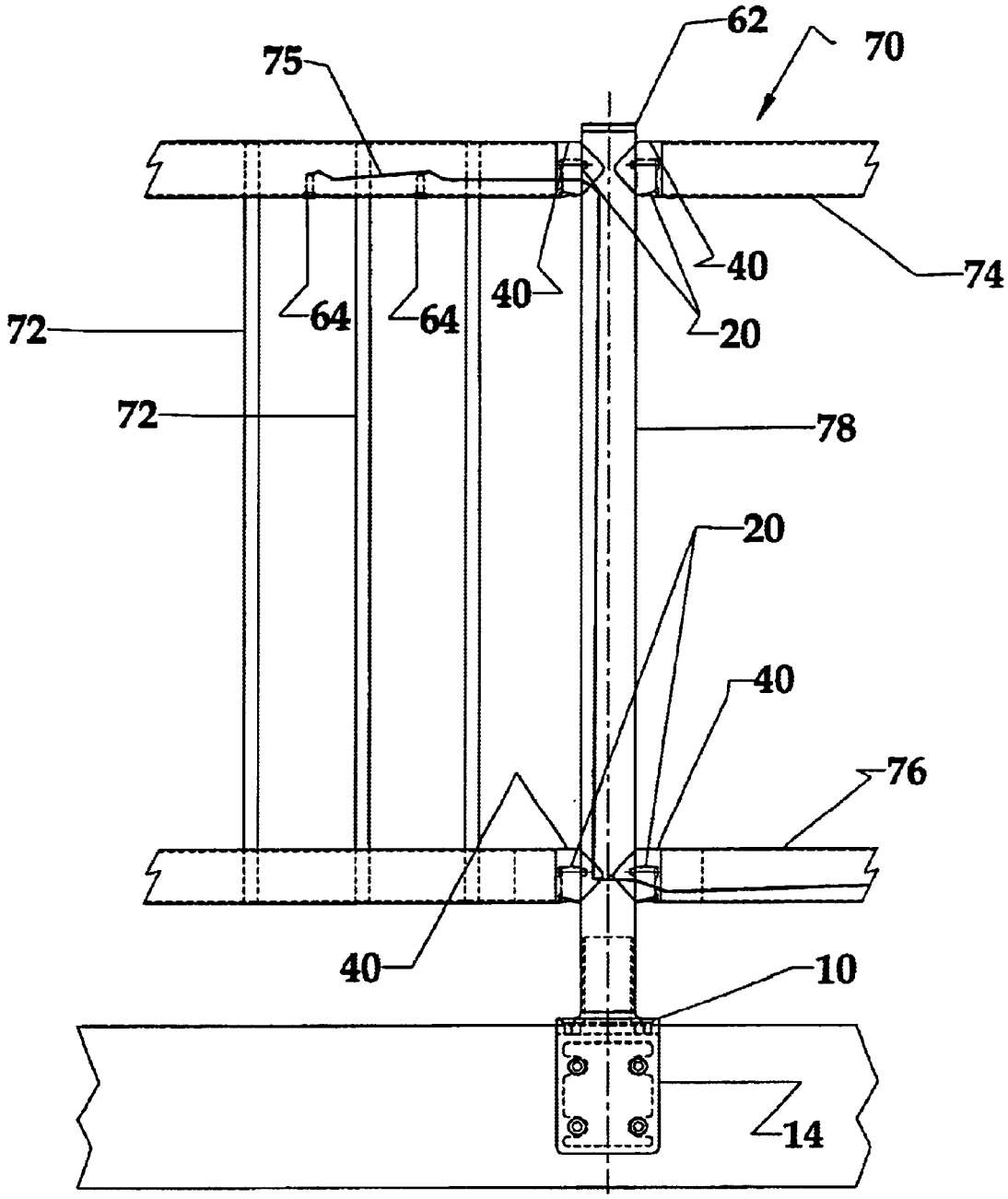
FIG. 7 is a side view of a railing system of this invention with spindles in a balustrade.

Referring also to FIG. 7, the post caps 62 will be fitted onto the top of a rail post or tube 78. Preferably, a commercially available glue or epoxy is added, which has the simple function of preventing a possible loss of the cap 62. If the railing system 70 is fitted with LED lights 64, the small size electric wires 75 from each horizontal section can be reached and connected if the cap 62 is removed, and subsequent access for maintenance or replacement is possible.

FIG. 7 shows an illustration of an embodiment of the railing system 70 of this invention with the tubular components being vertical spindles in a baluster type arrangement. Depending on the building code, a maximum distance between each spindle 72 may be predetermined which governs the spacing between the tubes. At the desired spacing, holes that match the outside diameter of the spindles 72 are drilled into the underside of the top horizontal rail 74 and the top side of the lower horizontal rail 76.

The spindles 72 consist of identical pieces of straight rod, which has a slight chamfer at each end to allow easier inserting into the holes. The length of each spindle 72 is identical, and is determined by the desired distance between the top rail 74 and bottom rail 76. A section is assembled on the floor by simply inserting the spindles 72 into the holes of the bottom rail 76 and the top rail 74. The length of the spindles 72 determines the total height of the baluster, since they touch the inside of the horizontal rails at the lowest and the highest points. The completed section is held together temporarily by tape, rubber "bungee cord" or similar, and then slotted into the four dovetail connectors 20 attached to the rail post 78 from the top and pushed down. Once the four hidden screws have been tightened, there is no possible movement by the spindles 72 as they are captured and held tight by the top rail 74 and bottom rail 76.

Figure 8:
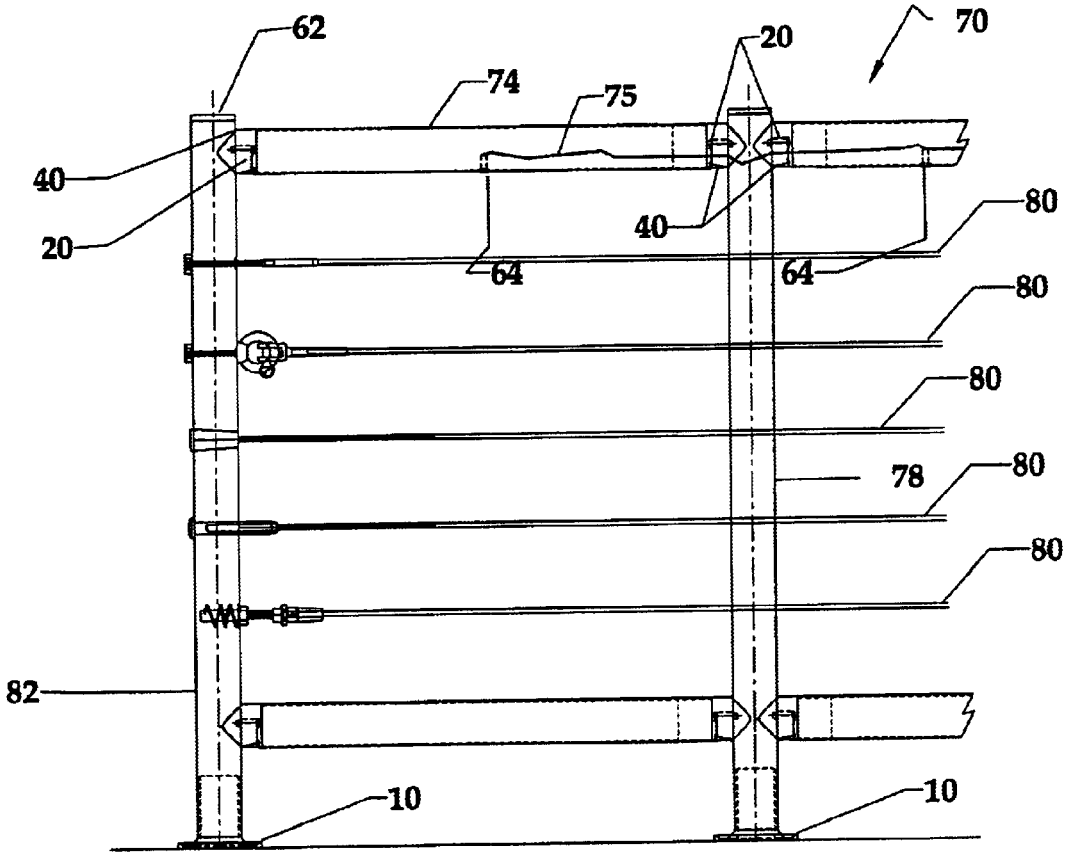
FIG. 8 is a side view of a railing system of this invention using commercially available wire rope systems.

FIG. 8 represents a rail system 70 using horizontal wire rope 80 strands or similar commercially available cable systems which pass through each upright tube or rail post 78 at the desired height. Each horizontal wire rope 80 is attached to the end posts 82 and is tightened. The resulting horizontal pulling force obtained by the tensioning acts to compress the horizontal tubes and thus further strengthens the completed rail system 70. The rail system 70 of this invention may be used with many possible attachments and is not limited to the examples described herein. In one embodiment, as shown in FIG. 8, LED Lights 64 are attached to the railing. Wiring 75 for such LED lights is threaded through the rails and posts to make, the railing more aesthetically pleasing.

Although the invention has been described with respect to various embodiments, it should be realized this invention is also capable of a wide variety of further and other embodiments.

What is claimed is:

1. A modular railing system comprising:

at least one substantially vertical post having a preselected outer dimension;

at least one substantially horizontal rail extending at an end thereof from said at least one substantially vertical post; and a connecting fixture for attaching said at least one substantially horizontal rail to said at least one substantially vertical post, said connecting fixture including:

a first connective fitting having an end shaped to mate with the outer dimension of said at least one substantially vertical post and a means for aligning said first connecting fitting to said at least one substantially vertical post and which increases vertical and horizontal shear strength between said first connective fitting and said at least one substantially vertical post during connection therebetween, a second connective fitting capable of connecting to said at least one substantially horizontal rail on one end thereof and having a recessed underside at another end thereof, said recessed underside receiving said first connective fitting therein, a side wing portion at said another end of said second connective fitting shaped to an inner dimension capable of mating with said outer dimension of said at least one substantially vertical post, such that when said recessed underside of said second connective fitting receives said first connective fitting therein, said first connective fitting fits substantially therein, and means for removably attaching said first connective fitting to said second connective fitting.

2. The system of claim 1 wherein the first connective fitting has a protrusion on said end and said at least one substantially vertical post has an aperture capable of receiving said protrusion such that said first connective fitting can be secured to said at least one substantially vertical post with said protrusion mated within said aperture.

3. The system of claim 1 further comprising another connecting fixture, said connecting fixture an said another connecting fixture secured substantially adjacent to each other with respect to said at least one substantially vertical post and said connecting fixture and said another connecting fixture each having a wing portion conformed to permit securement of said connecting fixtures substantially adjacent to each other with respect to said at least one substantially vertical post at an angle of substantially 60 degrees or more with respect to each other.

4. The system of claim 3 wherein said angle is about 90 degrees to about 170 degrees.

5. The system of claim 3 wherein said angle is about 60 degrees to about 90 degrees.

6. The system of claim 3 wherein said angle is about 175 degrees to about 185 degrees.

7. The system of claim 3 wherein said second connecting fixture has said wing portion configured of a greater size on one side thereof than another side thereof.

8. The system of claim 6 wherein said first and second connecting fixtures are substantially identical.

9. The system of claim 1 further comprising LED lights and a means for securing said LED lights to said at least one substantially vertical post or said at least one substantially horizontal rail or both of said at least one substantially vertical post and said at least one substantially horizontal rail, and wiring for said LED lights is threaded within said at least one substantially vertical post or said at least one substantially horizontal rail.

10. The system of claim 1 further comprising at least one cap fitting capable of being connected to one end of said at least one substantially vertical post.

11. The system of claim 1 further comprising a plurality of substantially vertical spindles secured to said at least one substantially horizontal rail at space intervals.

12. The system of claim 11 wherein said at least one substantially horizontal rail has a series of spaced apertures having a dimension substantially similar to outside dimension of a plurality of substantially vertical spindles, respectively, and said plurality of substantially vertical spindles are attached to said at least one substantially horizontal rail by having an end thereof inserted into said spaced apertures.

13. The system of claim 1 further comprising a plurality of space apart horizontal cable strands secured to said at least one substantially vertical post and extending horizontally between said at least one substantially vertical post and a surface or between said at least one substantially vertical post and an adjacent vertical post.

14. The system of claim 1 further comprising:

at least one base mounted on a surface, said at least one base having a protrusion on the side opposite said surface;

means for mounting said at least one base on said surface; and said at least one substantially vertical post being of a hollow tubular configuration capable of being fitted over said protrusion to attach said at least one substantially vertical post to said at least one base such that said at least one base provides support for said at least one substantially vertical post.

15. The system of claim 14 wherein said at least one base is substantially symmetrical and capable of being rotated 180 degrees with respect to said surface.

16. The system of claim 14 wherein said means for mounting said at least one base on said surface comprises:

at least one base bracket, said at least one base bracket having a top flange capable of mating with said at least one base and a side flange capable of being secured to a vertical surface, said top flange and said side flange being at a substantially 90 degree angle with respect to each other; and means for securing said side flange to said surface.

17. A modular railing system comprising:

at least one substantially vertical post having a preselected outer dimension;

at least one substantially horizontal rail extending at an end thereof from said at least one substantially vertical post; and a connecting fixture for attaching said at least one substantially horizontal rail to said at least one substantially vertical post, said connecting fixture including:

a first connective fitting having a side shaped to mate with the outer dimension of said at least one vertical post and a means for securing said first connecting fitting to said at least one substantially vertical post, a second connective fitting having a knuckle joint at one end thereof and having a recessed underside at another end thereof, said recessed underside receiving said first connective fitting therein, a side wing portion at said another end of said second connective fitting shaped to a an inner dimension capable of mating with said outer dimension of said at least one substantially vertical post, such that said recessed underside of said second connective fitting receives said first connective fitting therein, a third connective fitting capable of connecting at one end thereof to a rail and having another end shaped to mate with said knuckle joint of said second connective fitting;

means for removably connecting said knuckle joint of said second connective fitting and said another end of said third connective fitting such at said third connective fitting can be positioned at an angle in a vertical plan with respect to said second connective fitting; and means for removably attaching said first connective fitting to said second connective fitting.

18. The system of claim 17 wherein the first connective fitting has a protrusion on said end and said at least one substantially vertical post has an aperture capable of receiving said protrusion such that said first connective fitting is secured to said at least one substantially vertical post with said protrusion mated within said aperture.

19. The system of claim 17 further comprising LED lights and means for securing said LED lights to said at least one substantially vertical post or said at least one substantially horizontal rail or both of said at least one substantially vertical post and said at least one substantially horizontal rail wherein wiring for said LED light is threaded within said at least one substantially vertical post or said at least one substantially horizontal rail.

20. The system of claim 17 further comprising at least one cap fitting capable of being connected to one end of said at least one substantially vertical post.

21. The system of claim 17 further comprising a plurality of substantially vertical spindles secured to said at least one substantially horizontal rail at spaced intervals.

22. The system of claim 21 wherein said at least one substantially horizontal rail has a series of spaced apertures having a dimension substantially similar to outside dimension of a plurality of substantially vertical spindles, respectively, and said plurality of substantially vertical spindles are attached to said at least one substantially horizontal rail by having an end thereof inserted into said spaced apertures.

23. The system of claim 17 further comprising a plurality of space apart horizontal cable strands secured to said at least one substantially vertical post and extending horizontally between said at least one substantially vertical post and a surface or between said at least one substantially vertical post and an adjacent substantially vertical post.

24. The system of claim 17 further comprising:

at least one base mounted on a surface, said at least one base having a protrusion on a side opposite said surface;

means for mounting said at least one base on said surface; and said at least one substantially vertical post being of a hollow tubular configuration capable of being fitted over said protrusion to attach said at least one substantially vertical post to said at least one base such that said at least one base provides support for said at least one substantially vertical post.

25. The system of claim 24 wherein said at least one base is substantially symmetrical and capable of being rotated 180 degrees with respect to said surface.

26. The system of claim 24 wherein said means for mounting said at least one base on said surface comprises:

at least one base bracket, said at least one base bracket having a top flange capable of mating with said at least one base and a side flange capable of being secured to a vertical surface, said top flange and said side flange being at a substantially 90 degree angle with respect to each other; and means for securing said side flange to said surface.

27. The system of claim 17 further comprising another connecting fixture, said another connecting fixture comprising:

a first connective fitting having an end shaped to mate with the outer dimension of said at least one substantially vertical post and a means for securing said first connective fitting to said at least one substantially vertical post, a second connective fitting capable of connecting to said at least one substantially horizontal rail on one end thereof and having a recessed underside at another end thereof, said recessed underside receiving said first connective fitting therein, a side wing portion at said another end of said second connective fitting shaped to a an inner dimension capable of mating with said outer dimension of said at least one vertical post, such that said recessed underside of said second connective fitting receives said first connective fitting therein, said first connective fitting is substantial unseen, and means for removably attaching said first connective fitting to said second connective fitting;

wherein said another connecting fixture and said connecting fixture, are secured substantially adjacent to each other with respect to said at least one substantially vertical post and said connecting fixture and said another connecting fixture have a wing portion of each conformed to permit securement substantially adjacent to each other with respect to said at least one substantially vertical post at an angle of substantially 60 degrees or more with respect to each other.

* * * * *

UNITED STATES PATENT AND TRADEMARK OFFICE

CERTIFICATE OF CORRECTION

PATENT NO. : 6,860,472 B2
DATED : March 1, 2005
INVENTOR(S) : Striebel et al.

It is certified that error appears in the above-identified patent and that said Letters Patent is hereby corrected as shown below:

Column 7,
Line 51, "space intervals" should read -- spaced intervals --;
Line 61, "space apart" should read -- spaced apart --;

Column 8,
Line 42, "to a an" should read -- to an --;
Line 55, "vertical plan" should read -- vertical plane --;

Column 9,
Line 1, "LED light" should read -- LED lights --;
Line 12, "to outside" should read -- to an outside --;
Line 19, "space apart" should read -- spaced apart --; and Column 10,
Line 22, "to a an" should read -- to an --.

Signed and Sealed this

Seventeenth Day of May, 2005

JON W. DUDAS
*Director of the United States Patent and Trademark Office*